US008186553B2

(12) United States Patent
Tanimoto et al.

(10) Patent No.: US 8,186,553 B2
(45) Date of Patent: May 29, 2012

(54) FASTENER DRIVING TOOL

(75) Inventors: Hideyuki Tanimoto, Hitachinaka (JP); Toshihito Sakaba, Hitachinaka (JP); Hiroyuki Oda, Hitachinaka (JP); Yoshihiro Nakano, Hitachinaka (JP); Kenji Naganuma, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 126 days.

(21) Appl. No.: 12/530,493

(22) PCT Filed: Apr. 2, 2008

(86) PCT No.: PCT/JP2008/056965

§ 371 (c)(1),
(2), (4) Date: Sep. 9, 2009

(87) PCT Pub. No.: WO2008/123627

PCT Pub. Date: Oct. 16, 2008

(65) Prior Publication Data

US 2010/0140316 A1 Jun. 10, 2010

(30) Foreign Application Priority Data

Apr. 3, 2007 (JP) ..... 2007-097506

(51) Int. Cl.
*B25C 5/15* (2006.01)

(52) U.S. Cl. ..... 227/132; 227/120; 173/81

(58) Field of Classification Search ..... 227/81, 227/120, 129, 132, 139; 173/81, 83, 217
See application file for complete search history.

(56) References Cited

U.S. PATENT DOCUMENTS

| | | | | |
|---|---|---|---|---|
| 2,819,466 | A * | 1/1958 | Campbell et al. | 227/127 |
| 3,004,260 | A * | 10/1961 | Van Den Elzen | 227/134 |
| 4,323,127 | A * | 4/1982 | Cunningham | 173/53 |
| 5,320,270 | A | 6/1994 | Crutcher | |
| 5,511,715 | A * | 4/1996 | Crutcher et al. | 227/131 |
| 5,720,423 | A * | 2/1998 | Kondo et al. | 227/130 |
| 6,607,111 | B2 * | 8/2003 | Garvis et al. | 227/131 |
| 6,899,260 | B2 * | 5/2005 | Sun | 227/132 |
| 6,997,367 | B2 * | 2/2006 | Hu | 227/132 |
| 7,152,774 | B2 * | 12/2006 | Chen | 227/131 |
| 7,543,728 | B2 * | 6/2009 | Spasov et al. | 227/132 |
| 7,604,149 | B2 * | 10/2009 | Tsai et al. | 227/132 |
| 2006/0175374 | A1 * | 8/2006 | Zahner et al. | 227/10 |
| 2008/0257934 | A1 * | 10/2008 | Tanimoto et al. | 227/146 |

FOREIGN PATENT DOCUMENTS

| | | | |
|---|---|---|---|
| DE | 196 29 762 | A1 | 1/1997 |
| WO | WO 2007/142996 | A | 12/2007 |

* cited by examiner

*Primary Examiner* — Paul Durand
(74) *Attorney, Agent, or Firm* — Kilpatrick Townsend & Stockton LLP

(57) ABSTRACT

A fastener driving tool providing a prolonged durability and stabilized fastener driving operation. The tool includes a housing 2, a motor 31 disposed in the housing 2, a plunger 63 disposed in the housing and driven by the motor 31 for driving a nail 1A, a cable member 52 connected to the plunger 63 for pulling the plunger 63 from its bottom dead center where the nail is driven into a workpiece to a top dead center, and a drum 51 driven by the motor for winding the cable member thereover. A cable member is wound over the drum by a length greater than a linear distance between the bottom dead center and the top dead center. The cable member is flexed or deflected due to own weight when the plunger is at the bottom dead center.

8 Claims, 14 Drawing Sheets

FASTENER DRIVING TOOL

TECHNICAL FIELD

The present invention relates to a fastener driving tool, and more particularly, to an electrical fastener driving tool.

BACKGROUND ART

In a conventional fastener driving tool, energy is accumulated in a housing by a rotation of a motor, and the accumulated energy drives a plunger for driving a fastener into a workpiece. A coil spring is one example that accumulates energy therein by way of a driving force of the motor.

DISCLOSURE OF THE INVENTION

The fastener driving is performed by converting a kinetic energy of the plunger into fastener driving energy. However, surplus kinetic energy remains if the kinetic energy of the plunger is greater than the fastener driving energy. A bumper made from an elastic material such as a rubber is provided in order to absorb the surplus energy.

However, fastener driving energy may be small if the workpiece is made from a soft material. In this case, excessively large surplus kinetic energy remains, so that the impact may be transmitted to the cable. In the latter case, damage to the cable and to the motor drivingly connected to the cable may occur. Such drawback can be eliminated if a cable having a large diameter is used. However, resultant fastener driving tool becomes heavy and bulky. Further, flexibility of the cable may be degraded to cause loss of energy for the fastener driving. Consequently, instable fastener driving operation may occur.

It is therefore, an object of the present invention to provide a fastener driving tool having sufficient durability and capable of providing stabilized fastener driving operation.

In order to attain the above and other objects, the present invention provides a fastener driving tool including a housing, a motor, a plunger, a cable member, and a drum. The motor is provided in the housing. The plunger is provided in the housing and is movable between its top dead center and its bottom dead center for impacting a fastener in a fastener driving direction. The cable member is connected to the plunger for pulling the plunger from the bottom dead center to the top dead center. The drum is driven by the motor for winding the cable member by a length greater than a distance between the top dead center and the bottom dead center.

Preferably, the cable member is connected to the drum and is deflectable between the drum and the plunger when the plunger is at the bottom dead center.

With the above-described arrangement, the cable member is flexed or deflected when the plunger is moved to the bottom dead center. Since the cable member is made from a flexible material that allows the cable to be wound over the drum, an impact force generated at the plunger can be absorbed by the flexed cable member. Further, tensile force applying to the cable member can be reduced when the plunger is moved to the bottom dead center. Thus, prolonged durability of the fastener driving tool can result.

Preferably, the cable member is connected to the plunger at a first connecting position and to the drum at a second connecting position, and the cable member has a length from 1 mm to 10 mm greater than a linear distance between the first connecting position and the second connecting position when the plunger is at the bottom dead center.

With this arrangement, sufficient deflection of the cable member can be provided. Further, the deflection is not so increased, entanglement of the cable member with ambient components in the housing can be restrained or avoided.

Preferably, the cable member includes a cable portion having one end and another end connected to the drum, and a retained portion provided at the one end of the cable portion and retained by the plunger. The plunger has a retaining portion formed with a closed space defined by an end portion and formed with one of a bore and a groove extending through the end portion in the fastener driving direction. The retained portion is movable in the closed space in the fastener driving direction, and the cable portion extends through the one of the bore and the groove which prevents the retained portion from passing therethrough. The retained portion is spaced away from the end portion when the plunger is at the bottom dead center. In this state, the retained portion is spaced away from the end portion by a distance not less than twice as large as a diameter of the cable portion.

With this arrangement, the plunger can be moved toward its top dead center upon abutment of the retained portion to the retaining portion. The retained portion is in abutment with the retaining portion for pulling the cable member during movement of the plunger toward its bottom dead center, so that the cable member is unwound from the drum. However, the abutment between the retained portion and the retaining portion is shut off or released when the plunger reaches its bottom dead center, so that the retained portion is moved away from the retaining portion. Therefore, mechanical association between the cable member and the plunger can be shut off at the bottom dead center, and accordingly, transmission of impact from the plunger to the cable member can be restrained. Even if the abutment between the retained portion and the retaining portion is maintained at the bottom dead center, transmission of impact from the plunger to the cable member can still be restrained since deflection occurs at the cable member in this instance.

In the cable member itself, inertial force acts on the cable member due to its rapid movement toward the bottom dead center. Stress concentration may occur due to the inertial force at the bottom dead center side of the cable member because of the sudden stop of the plunger at the bottom dead center. However, since the cable member can be deflected at the bottom dead center, stress concentration can be moderated or dispersed adequately to avoid bending or buckling of the cable member. In particular, the retained portion can be spaced away from the end portion by a distance not less than twice as large as a diameter of the cable portion when the plunger is at the bottom dead center. With such arrangement, impact transmission can be suitably restrained or reduced.

Preferably, the cable portion is rotatable about its axis with respect to the retaining portion. With this arrangement, any distortion or twisting does not occur in the cable member even if the plunger is subjected to a rotation force.

Preferably, the fastener driving tool further includes a nose supported to the housing and movable in the fastener driving direction with respect to the housing for guiding movement of a fastener driven by the plunger. The nose has a tip end in the fastener driving direction, and the plunger has a striking end protrudable from the tip end.

With this arrangement, the nose can remain or stay on the workpiece even if the housing is urged to be moved in a direction opposite to the fastener driving direction due to reaction force of the fastener driving operation. Thus, separation of the nose from the workpiece can be avoided at the fastener driving timing even if the nose is not strongly urged toward the workpiece. Since the striking end of the plunger protrudes from the tip end of the nose, the striking end can be moved toward the workpiece even if the housing is urged to be moved in the direction opposite to the fastener driving direction at the fastener driving timing. Consequently, the fastener can be accurately driven into the workpiece. Furthermore, the protruding arrangement can facilitate sharp shooting the fastener by aligning the striking end of the plunger with an intended fastener driving point.

Preferably, the fastener driving tool includes a nose urging spring interposed between the nose and the housing for biasing the nose in a direction opposite to the fastener driving direction. With this arrangement, the nose can be positioned close to the housing in a state where fastener driving operation is not performed.

Preferably, the fastener driving tool further includes a biasing spring associated with the plunger for biasing the plunger in the fastener driving direction. The biasing spring is configured to accumulate a driving force of the motor as a resilient energy. With this arrangement, acceleration of the plunger can be realized with a light-weight and simple structure.

BRIEF DESCRIPTION OF THE DRAWINGS

In the drawings;

FIG. 4A is a perspective view showing the clutch mechanism in a state that a drum is located in its initial position;

FIG. 4(*c*) is a perspective view showing the clutch mechanism in a state that a power transmission pin is located on a shut-off position;

FIG. 4(*d*) is a perspective view showing the clutch mechanism in a state that a plunger is performing a nail driving operation;

FIG. 4(*e*) is a perspective view showing the clutch mechanism in a state after the nail driving operation;

FIG. 5(*b*) is a cross-sectional view showing a periphery of the nose portion in a state during the nail driving operation;

FIG. 5(*c*) is a cross-sectional view showing a periphery of the nose portion in a state after the nail driving operation;

FIG. 13(*b*) is a cross-sectional view of the portion including the plunger in the fastener driving tool according to the second embodiment, in which the plunger has moved to its top dead center;

FIG. 13(*c*) is a cross-sectional view of the portion including the plunger in the fastener driving tool according to the second embodiment, in which the plunger has moved to its bottom dead center;

BRIEF DESCRIPTION OF REFERENCE NUMERALS

Figure 1:
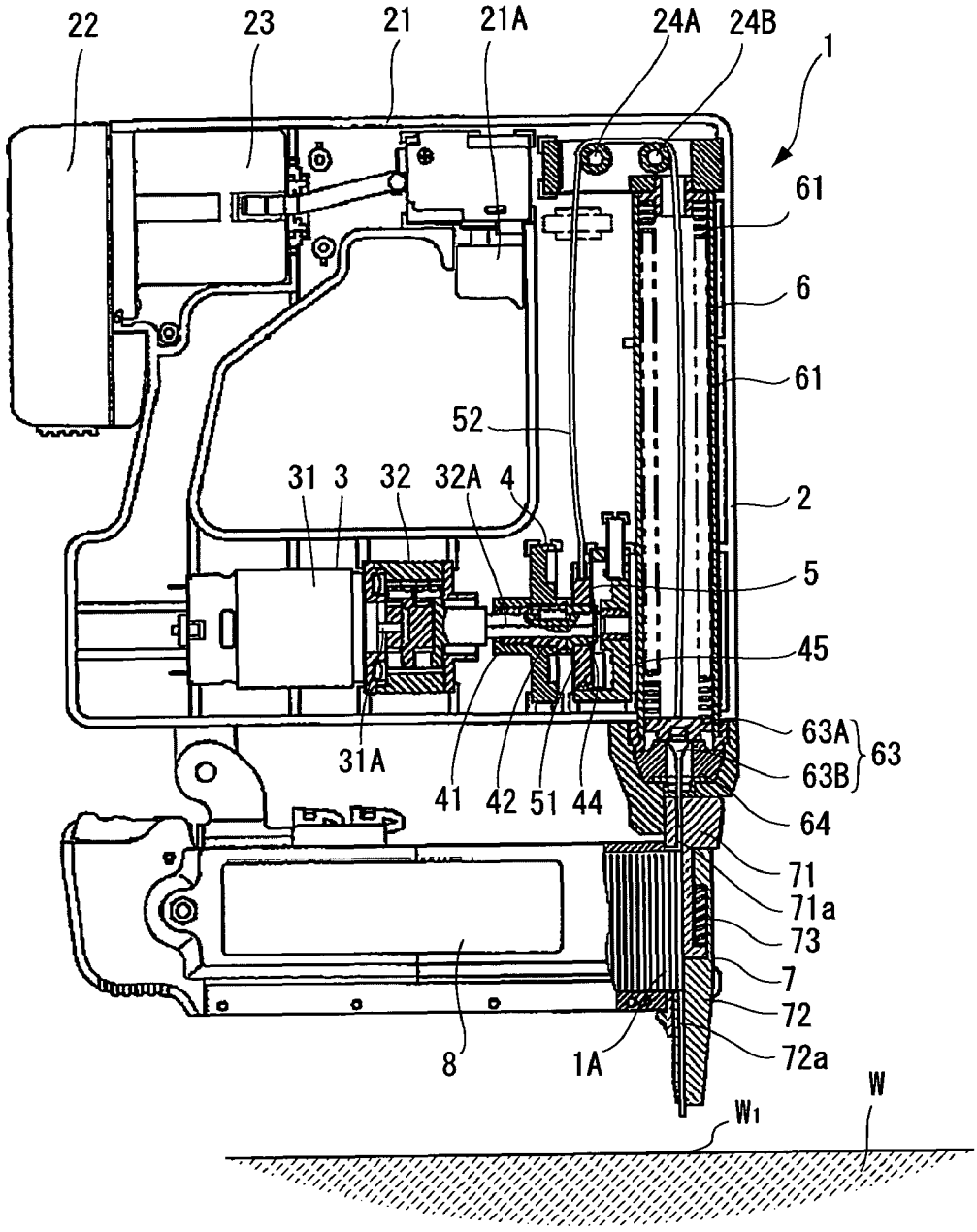
FIG. 1 is a cross-sectional view of a fastener driving tool according to a first embodiment of the present invention.

1: nail gun
1A: nail
2: housing
3: driving portion
4: clutch mechanism
5: transmission portion
6: coil spring portion
7: nose portion
8: magazine
21: handle
21A: trigger
22: battery
23: power supply portion
24A, 24B: guide pulley
31: motor
31A: driving shaft
32: planetary gear mechanism
32A: output shaft
41: guide plate
41*a*: through-hole
41*b*: pin guide groove
42: pin supporting portion
42*a*: through-hole
42B: projecting portion
42*b*: slit
43: power transmission pin
43A: pin groove sliding portion
43B: pin hook portion
43C: pin sliding portion
44: drum hook
44A: bearing
44B: hook portion
45: shaft supporting portion
45B: latched portion
51: drum
51A: latching portion

51*a*: through-hole
51*b*: wire guide groove
52: cable
61: spring guide
61*a*: through-hole
62: coil spring
63: plunger
63A: urging portion
63B: blade
63*a*: air passage
63*b*: groove
64: bumper
71: base
71*a*: through-hole
72: nose
72*a*: injection hole
73: nose urging spring
104: clutch mechanism
141: guide plate
141A: rail portion
141B: slant surface
141C: plane end surface
142: pin supporting portion
142A: pin urging spring
143: power transmission pin
144: drum hook
201: nail gun
201A: nail
202: housing
203: driving portion
204: clutch mechanism
205: transmission portion
206: coil spring portion
207: nose portion
208: magazine
221: handle
221A: trigger
221B: switch
222: battery
231: motor
231A: driving shaft
232: planetary gear mechanism
232A: output shaft
232B: gear
234A: pulley
234B: belt
251: drum
252: cable
252A: retained portion
252B: cable portion
261: spring guide
262: coil spring
263: plunger
263A: urging main body
263B: blade
263C: retaining portion
263*a*: space
263*b*: hole
264: bumper

BEST MODE FOR CARRYING OUT THE INVENTION

A fastener driving tool according to a first embodiment of the present invention will be described with reference to FIGS. 1 through 5(*c*). The fastener driving tool shown in FIG. 1 is an electrically-operated type nail gun 1 where a fastener such as a nail 1A is adapted to be driven into a workpiece W such as a wood and a gypsum plaster board. The nail gun 1 mainly includes a housing 2, a driving portion 3, a clutch mechanism 4, a transmission portion 5, a coil spring portion 6, a nose portion 7, and a magazine 8. Hereinafter, a direction in which a plunger 63 described later moves away from a bumper 64 described later will be described as an upper direction, and a direction in which the plunger 63 is urged by a coil spring 62 described later to strike the nail 1A will be described as a lower direction.

The housing 2 is made from resin such as nylon and polycarbonate and accommodates therein the driving portion 3 and the like. A handle 21 is provided on an upper section of the housing 2 and is provided with a trigger 21A to control the driving portion 3. A battery 22 is detachably provided on the handle 21. The handle 21 is also provided with a power supply portion (not shown) to supply electric power supplied from the battery 22 to the driving portion 3.

The driving portion 3 mainly includes a motor 31 and a planetary gear mechanism 32. The motor 31 is provided on a lower section of the housing 2 and is located below the handle 21. The motor 31 has a driving shaft 31A directing perpendicular to the upper and lower direction. The planetary gear mechanism 32 is provided on an end of the driving shaft 31A and is a well-known gear mechanism including a sun gear, an orbital gear, and an output shaft 32A. The output shaft 32A of the planetary gear mechanism 32 is disposed coaxially with the driving shaft 31A. The planetary gear mechanism 32 can have a compact size, and reduced reduction ratio of the planetary gear mechanism 32 can be provided. Thus, a compact nail gun 1 can result, even if the reduction ratio of the planetary gear mechanism 32 is increased.

Figure 2:
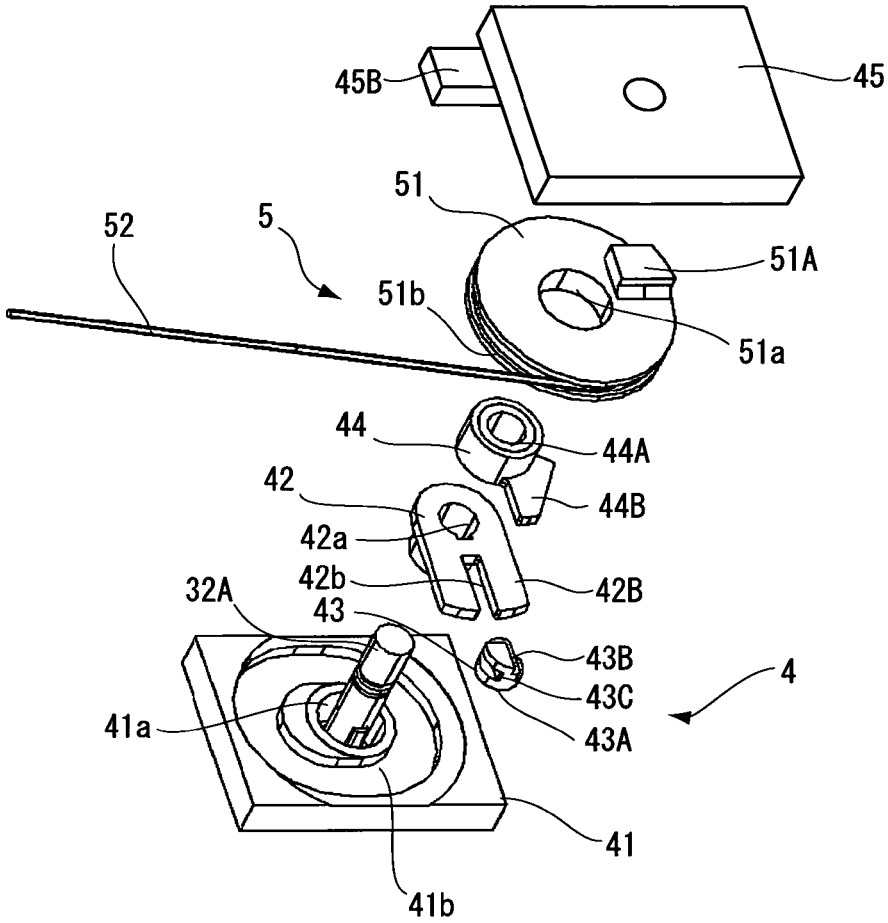
FIG. 2 is an exploded perspective view of a clutch mechanism of the fastener driving tool according to the first embodiment of the present invention.

As shown in FIGS. 1 and 2, the clutch mechanism 4 mainly includes a guide plate 41, a pin supporting portion 42, a power transmission pin 43, and a drum hook 44. The clutch mechanism 4 is disposed near the driving portion 3 and is connected to the output shaft 32A.

As shown in FIG. 1, the guide plate 41 is accommodated in and fixed to the housing 2. As shown in FIG. 2, the guide plate 41 is formed with a through-hole 41*a*, through which the output shaft 32A penetrates, at a center of the guide plate 41. The guide plate 41 has a surrounding portion that surrounds the through-hole 41*a*. The surrounding portion is formed with a looped pin guide groove 41*b* having an oblong shape. A distance from a central axis of the output shaft 32A to an outer edge of the pin guide groove 41*b* is not constant in a circumferential direction of the outer edge. Specifically, the central axis of the output shaft 32A is located at one imaginary focal position of the pin guide groove 41*b* (oblong shape has two focal positions).

The pin supporting portion 42 is disposed at a position opposite to the driving portion 3 with respect to the guide plate 41. The pin supporting portion 42 is formed with a through-hole 42*a*. The pin supporting portion 42 is rotatable together with the output shaft 32A by fixedly inserting the output shaft 32A into the through-hole 42*a*. The pin supporting portion 42 has a projecting portion 42B extending in a direction substantially perpendicular to a penetration direction of the through-hole 42*a*. The projecting portion 42B is formed with a slit 42*b* extending in a direction substantially perpendicular to the penetration direction of the through-hole 42*a*.

The power transmission pin 43 has a pin groove sliding portion 43A located at one end thereof, a pin hook portion 43B located at another end thereof, and a pin sliding portion 43C located between the pin groove sliding portion 43A and the pin hook portion 43B. The pin sliding portion 43C is inserted into the slit 42*b* and slidable with respect to the pin supporting portion 42. The pin groove sliding portion 43A is inserted into the pin guide groove 41*b* while the power transmission pin 43 is inserted into the slit 42*b*. The power transmission pin 43 slidably circularly moves in the pin guide groove 41*b*.

The pin guide groove 41*b* has the oblong shape around the central axis of the output shaft 32A. The pin supporting portion 42 is fixed to the output shaft 32A, and is rotatable about the central axis of the output shaft 32A. Therefore, the power transmission pin 43 inserted into the pin guide groove 41*b* moves toward and away from the central axis of the output shaft 32A in the slit 42*b* in accordance with a change in angular rotational position of the pin supporting portion 42. The pin hook portion 43B has a plane substantially perpendicular to a circularly moving direction of the power transmission pin 43.

The drum hook 44 includes a bearing 44A formed with a through-hole. The output shaft 32A is inserted into the through-hole of the bearing 44A. The drum hook 44 is disposed at a position opposite to the guide plate 41 with respect to the pin supporting portion 42. The drum hook 44 is rotatable about the central axis of the output shaft 32A, but is not rotatable together with the output shaft 32A. The drum hook 44 includes a hook portion 44B extending in a direction perpendicular to the central axis of the output shaft 32A. The hook portion 44B is capable of contacting with the pin hook portion 43B while the drum hook 44 is assembled to the output shaft 32A.

A shaft supporting portion 45 is provided on a position opposite to the driving portion 3 with respect to the clutch mechanism 4. The shaft supporting portion 45 is fixed to the housing 2 and rotatably supports a distal end of the output shaft 32A. The shaft supporting portion 45 has one side facing the clutch mechanism 4, and includes a latched portion 45B on the one side. The latched portion 45B is capable of latching onto a latching portion 51A described later.

As shown in FIG. 1, the transmission portion 5 mainly includes a drum 51 and a cable 52. As shown in FIG. 2, the drum 51 has a ring shape forming a through-hole 51*a*. One end of the drum hook 44 opposite to the driving portion 3 is force-fitted with the through-hole 51*a*. The drum 51 is located adjacent to the clutch mechanism 4. Since the drum 51 is connected to the drum hook 44 by force-fitting with the through-hole 51*a*, the drum 51 is coaxially rotatable together with the drum hook 44. The drum 51 is formed with a cable guide groove 51*b* at an entire circumference thereof.

The drum 51 includes the latching portion 51A protruding from one side surface thereof, the one side surface being positioned opposite to the clutch mechanism 4. The latching portion 51A and the latched portion 45B is configured to latch with each other in a state that the drum 51 is positioned at an angular rotational position where the drum 51 begins to wind the cable 52. Accordingly, the latching portion 51A and the latched portion 45B can define an initial position that the drum 51 begins to rotate.

A length of the circumference of the drum 51 is substantially four-thirds of a length that the coil spring 62 moves from a bottom dead center to a top dead center described later.

One end of the cable 52 is fixed to the cable guide groove 51*b* of the drum 51, and another end of the cable 52 is connected to an urging portion 63A described later. The cable 52 has fibrous steel wires bundled together as a wire bundle. A surface of the wire bundle is coated with a resin. Thus, the cable 52 has a high strength and flexibility. Since the surface of the wire bundle is coated with resin, the cable 52 does not damage to the drum 51 and the like such as scratching. Two guide pulleys 24A and 24B (FIG. 1) are provided in the housing 2 in order to suspend the cable 52.

The cable 52 has a length 10 mm or less greater than a distance between the fixing position of the cable 52 to the urging portion 63A and the drum 51 assuming that no deflection occurs in the cable 52. Therefore, the cable 52 is deflected or flexed due to its own weight when the plunger 63 is positioned at its bottom dead center. Further, since the residual length of the cable 52 is not so long, excessively large deflection is not provided. Consequently, entanglement of the cable 52 with ambient components in the housing 2 does not occur or will be restrained.

The coil spring portion 6 mainly includes a spring guide 61, the coil spring 62, and the plunger 63. The spring guide 61 is provided in the housing 2 as a separate member. The spring guide 61 has cylindrically two-layer structure. An outer layer of the spring guide 61 is made from aluminum or resin such as nylon and polycarbonate and defines an outer peripheral surface of the spring guide 61. An inner layer of the spring guide 61 is made from steel having hardness the same as that of the coil spring 62 and defines an inner peripheral surface of the spring guide 61. An axis of the spring guide 61 is parallel to the upper and lower direction. Accordingly, the spring guide 61 has an abrasion resistance against the coil spring 62 and can have a lightweight structure. The inner peripheral surface of the inner layer is coated with an ultrahigh molecular weight polyethylene layer that has a low coefficient of friction.

The coil spring 62 is inserted into the spring guide 61. The coil spring 62 is made from steel and has an outer diameter that is slightly smaller than an inner diameter of the spring guide 61. As described above, the inner layer of the spring guide 61 is made from steel having the hardness the same as that of the coil spring 62. Thus, frictional wearing of the inner layer can be lower than that of an inner layer made from resin when the coil spring 62 and the urging portion 63A described later are slidingly moved with respect to the spring guide 61. Further, since the inner peripheral surface of the inner layer of the spring guide 61 is coated with the ultrahigh molecular weight polyethylene layer, the abrasion resistance of the spring guide 61 against the coil spring 62 can be further improved. Furthermore, since the spring guide 61 is a separate member with respect to the housing 2, only the spring guide 61 can be replaced by a new spring guide if the spring guide 61 is damaged or excessively worn.

Figure 3:
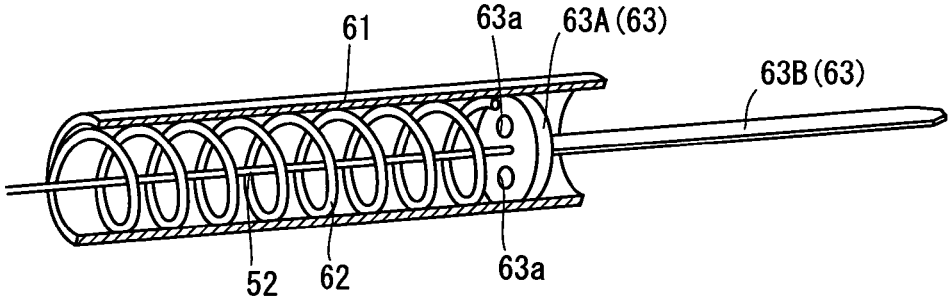
FIG. 3 is a perspective view partially cut away showing a spring guide and its associated components according to the first embodiment of the present invention.

As shown in FIG. 3, the plunger 63 has the urging portion 63A and a blade 63B. The urging portion 63A is located on a lower end of the coil spring 62. The urging portion 63A is made from a metal and has a disk shape having an outer diameter the same as that of the coil spring 62. The urging portion 63A is connected at a center position thereof to the other end of the cable 52 which extends through the coil spring 62. Thus, the urging portion 63A can be pulled by the cable 52, and is movable upwardly against a biasing force of the coil spring 62 along the spring guide 61, and can compress the coil spring 62. Since the outer diameter of the urging portion 63A is the same as that of the coil spring 62, the urging portion 63A can have an optimized size, thereby resulting in a compact nail gun 1. A position, where the urging portion 63A is positioned at its lowest position while being urged by the coil spring 62 in an initial state prior to nail driving operation, will be referred to as the bottom dead center. Another position, where the urging portion 63A is positioned at its highest position while being pulled by the cable 52, will be referred to as the top dead center. The urging portion 63A is formed with a pair of air passages 63*a* extending through a thickness of the urging portion 63A.

The blade 63B is an elongated plate and protrudes from a central portion of the urging portion 63A in a direction opposite to the cable 52. As shown in FIG. 1, the bumper 64 is provided below the urging portion 63A in the housing 2. The bumper 64 is made from a resin such as a flexible rubber, a urethane and the like.

Figure 5:
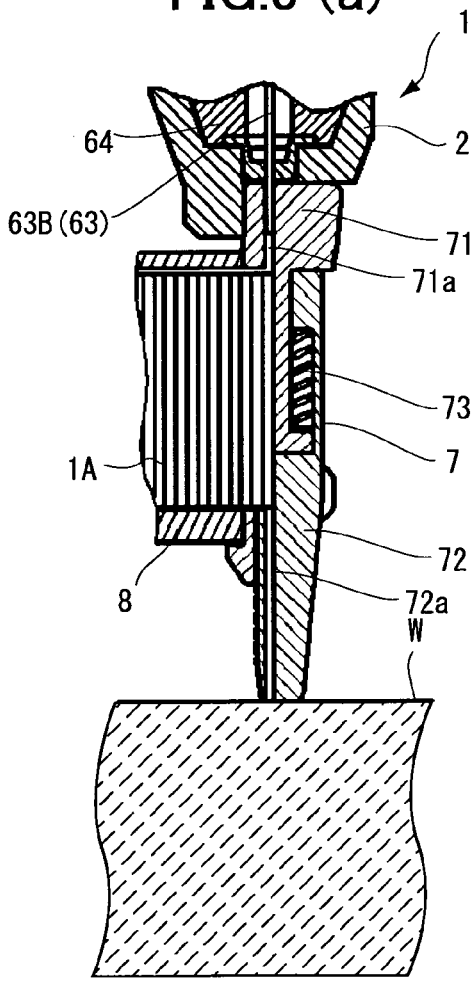
FIG. 5(*a*) is a cross-sectional view showing a periphery of a nose portion in a state before the nail driving operation.
Figure 5:
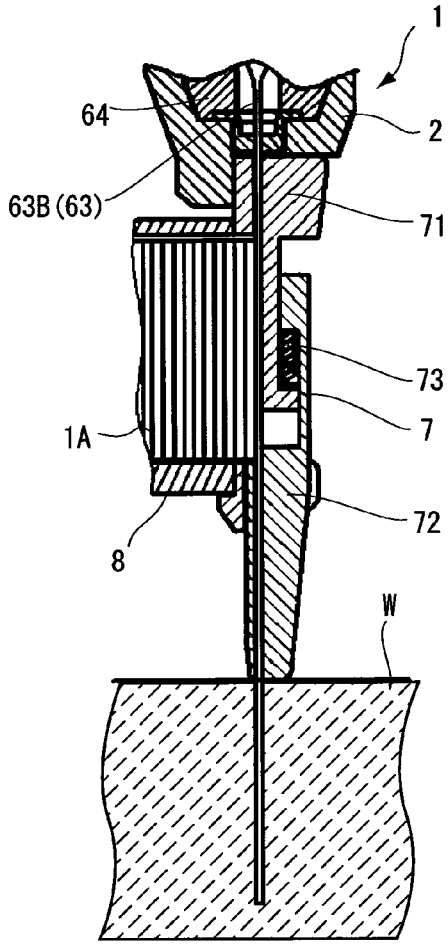
Figure 5:
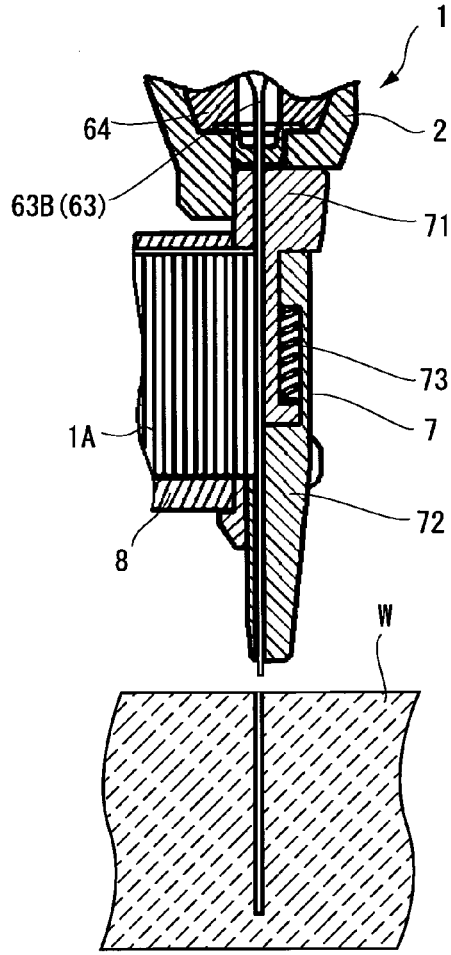

As shown in FIG. 1, the nose portion 7 is located below the coil spring portion 6. As shown in FIGS. 1 and 5(*a*), the nose portion 7 mainly includes a base 71, a nose 72, and a nose urging spring 73. The base 71 is fixed to the housing 2 by a screw and is formed with a through-hole 71*a* that allows the blade 63B to extend thereinto. The nose 72 is located below the base 71 and capable of moving in upper and lower direction with respect to the base 71. The nose 72 is formed with an injection hole 72*a* into which the blade 63B can extend. The nose urging spring 73 is interposed between the base 71 and the nose 72, and urges the nose 72 upwardly, i.e. in a direction opposite to a nail driving direction with respect to the base 71. Accordingly, the nose 72 can normally maintain contact with the base 71 by the urging force of the nose urging spring 73.

As shown in FIG. 1, in the initial state prior to nail driving operation, the blade 63B penetrates both of the through-hole 71*a* of the base 71 and the injection hole 72*a* of the nose 72, and a distal end of the blade 63B projects from a lowest edge of the nose 72 while the nose 72 contacts the base 71.

The magazine 8 is detachably provided on the nose portion 7 and accommodates a plurality of nails 1A. Each of the plurality of nails 1A is supplied to be spanned between the base 71 and the nose 72 to be driven by the blade 63B.

In the above-described nail gun 1, when the nail 1A is to be driven into the workpiece W, firstly, a target position, into which the nail 1A is driven, of the workpiece W is decided by contacting the distal end of the blade 63B projecting from the lowest edge of the nose 72 to a driven area W1 of a surface of the workpiece W. Since the blade 63B is positioned on a trajectory through which a driven nail 1A passes and the target nail driving position can be determined by the blade 63B projecting from the lowest edge of the nose 72, the nail driven position can be defined easily and accurately.

In a state that the driving position is decided, a user pulls the trigger 21A to supply power to the motor 31 and to rotate the driving shaft 31A. Rotation of the driving shaft 31A is transmitted to the output shaft 32A by way of the planetary gear mechanism 32 that decelerates rotating speed of the driving shaft 31A.

As shown in FIG. 4A, the pin supporting portion 42 coaxially fixed with the output shaft 32A rotates by the rotation of the output shaft 32A, and the power transmission pin 43 supported on the pin supporting portion 42 will be brought into abutment with the hook portion 44B of the drum hook 44. A position where the power transmission pin 43 abuts against the drum hook 44 is defined as a transmitting position. The drum 51 has an initial position where the latching portion 51A can latch with the latched portion 45B while the drum hook 44 is located in a position shown in FIG. 4A.

Figure 4:
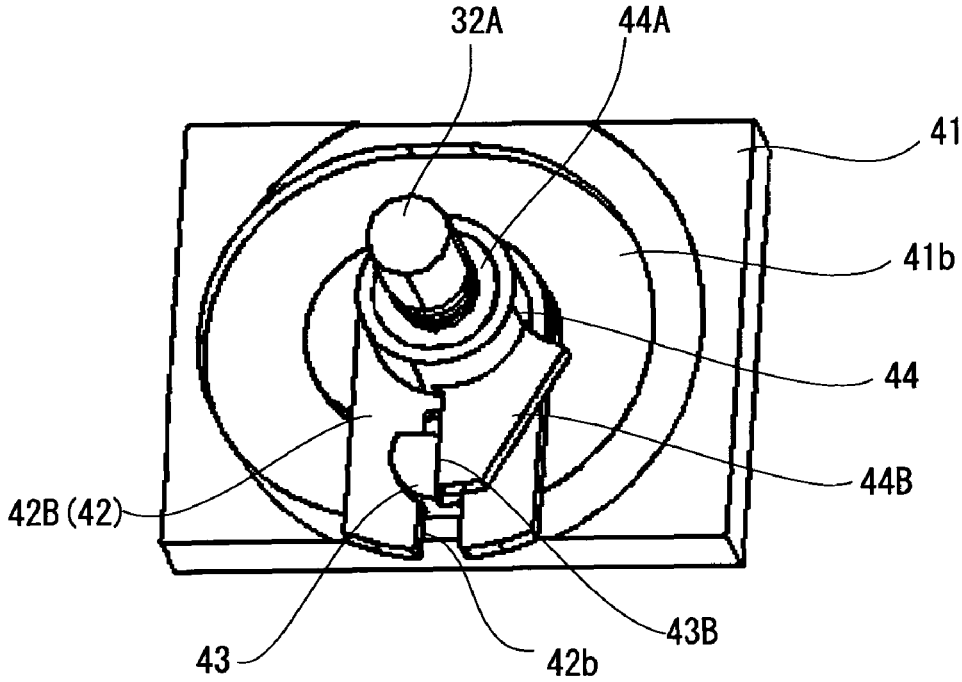
FIG. 4(*b*) is a perspective view showing the clutch mechanism in a state that the drum rotates together with an output shaft.
Figure 4:
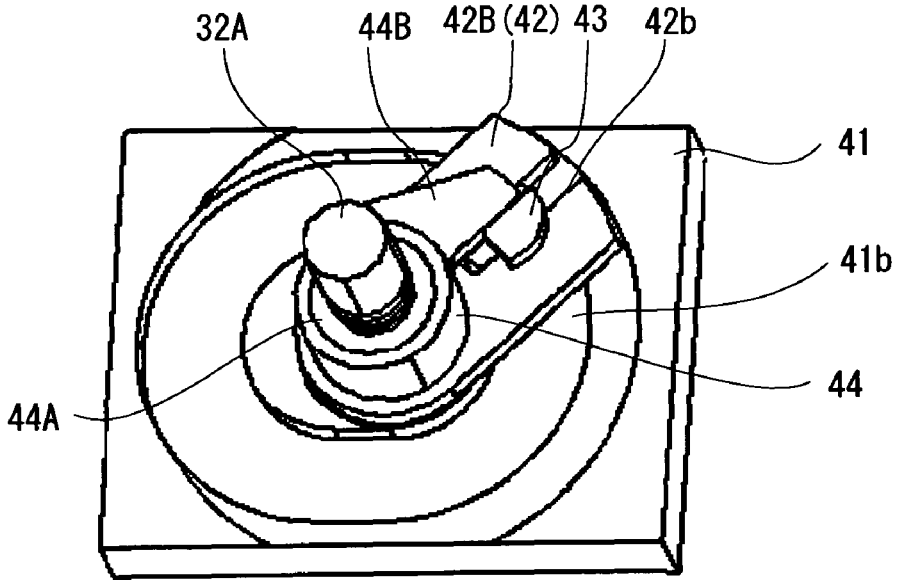
Figure 4:
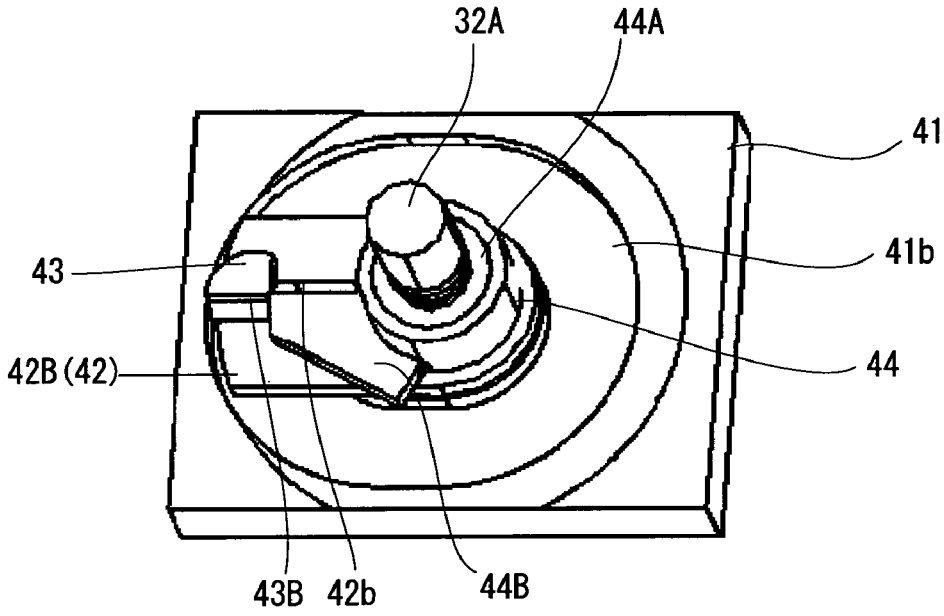
Figure 4:
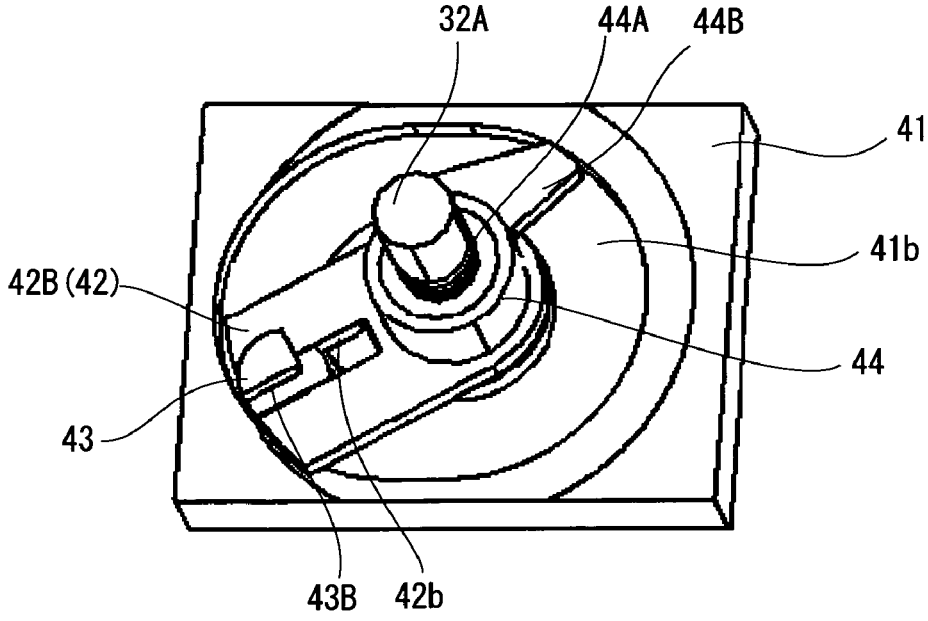
Figure 4:
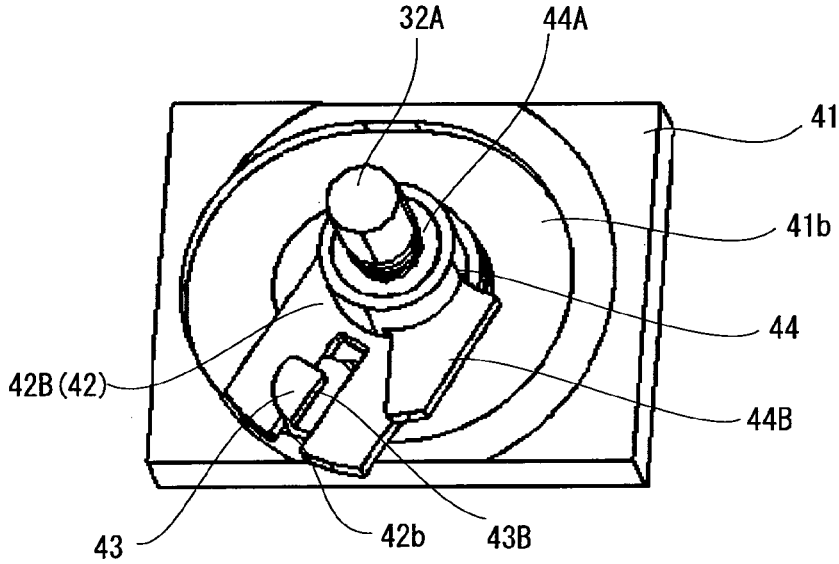

As shown in FIG. 4(*b*), the output shaft 32A and the pin supporting portion 42 rotate in a counterclockwise direction while the power transmission pin 43 is positioned at its transmission position. Thus, the drum hook 44 in abutment with the power transmission pin 43 also rotates. Since the drum 51 is fixed to drum hook 44, the drum 51 rotates and winds up the cable 52 over the cable guide groove 51*b*.

The urging portion 63A connected to the other end of the cable 52 is pulled upwardly by the cable 52 winding upwardly against the urging force of the coil spring 62, and compresses the coil spring 62. A locus of the connection position between the urging portion 63A and the cable 52 passes through an inner region of the coil spring 62, the inner region being defined by an inner surface of the coil spring 62, and approximately in conformance with a central axis of the coil spring 62 while compressing the coil spring 62. Thus, the urging portion 63A can be pulled in a direction parallel to the central axis of the coil spring 62. Therefore, the urging portion 63A moves in a state that a surface, to which the coil spring 62 contacts, of the urging portion 63A is perpendicular to the central axis of the coil spring 62.

The outer diameter of the urging portion 63A is substantially the same as that of the coil spring 62. Accordingly, excessive contact of the urging portion 63A and the coil spring 62 with the spring guide 61 can be eliminated, and a load imparted on the motor 31 can be only a load of the compression of the coil spring 62, thereby providing low electricity consumption at the motor 31.

In a state shown in FIG. 4(*c*), the output shaft 32A has rotated substantially 270 degrees from the state shown in FIG. 4A. In this state, the power transmission pin 43 moves away from the output shaft 32A along the slit 42*b* due to the oblong shape of the pin guide groove 41*b*, thereby releasing from the drum hook 44. Accordingly, a transmission of driving force from the output shaft 32A to the drum 51 rotatable together with the drum hook 44 is shut-off. A position where the power transmission pin 43 does not abut against the drum hook 44 is defined as a shut-off position. The plunger 63 is pulled substantially to the top dead center when the output shaft 32A rotates substantially 270 degrees from the state shown in FIG. 4A. Therefore, the coil spring 62 is compressed and has maximum resilient energy at the shut-off position.

Upon shutting off the transmission of the driving force to the drum 51, a pulling of the urging portion 63A by the cable 52 is stopped. Thus, the urging portion 63A rapidly moves toward the bottom dead center by the resilient energy of the coil spring 62, thereby impacting the nail 1A by the blade 63B. As shown in FIG. 4(*d*), since the cable 52 is released from the drum 51, the drum 51 and the drum hook 44 rotates in the clockwise direction opposite to a rotational direction of the output shaft 32A.

The spring guide 61 has a cylindrical shape and accommodates the urging portion 63A therein. Thus, a space, in which the coil spring 62 is accommodated, in the spring guide 61 is substantially hermetically-sealed space. The urging portion 63A divides the space in the spring guide 61 into a first space positioned above the urging portion 63A and a second space positioned below the urging portion 63A. When the urging portion 63A moves from the top dead center toward the bottom dead center, the urging portion 63A compresses an air in the second space of the spring guide 61. In this case, the urging portion 63A is subject to so-called an air damper effect, and the rapid movement of the urging portion 63A may be prevented. However, the pair of air passages 63*a* are formed in the urging portion 63A, so that the first space and the second space are in fluid communication with each other via the pair of air passages 63*a*. Therefore, the air damper effect can be prevented, and the urging portion 63A can be moved from the top dead center toward the bottom dead center rapidly.

Further, since the inner peripheral surface of the inner layer of the spring guide 61 is coated with the ultrahigh molecular weight polyethylene layer, a contact resistance between the spring guide 61 and the coil spring 62, which is being moved toward the bottom dead center, can be reduced. Accordingly, a wasteful consumption of the resilient energy accumulated in the coil spring 62 can be prevented, thereby increasing the impact force for the nail 1A.

The plunger 63 is rapidly moves downwards by the displacement of the coil spring 62 toward the bottom dead center, whereupon the blade 63B strikes against the nail 1A. In this case, resilient energy in the coil spring 62 is converted into kinetic energy of the plunger 63, and the kinetic energy of the plunger 63 is converted into impacting energy against the nail 1A. Since the kinetic energy of the plunger 63 is greater than the impacting energy, the plunger 63 will be moved toward the bottom dead center after driving the nail 1A and strikes against the bumper 64.

At the striking timing, impact force is generated in the plunger 63, and the impact will be transmitted to the cable 52. However, the cable 52 is deflected or flexed when the plunger 63 is at its bottom dead center. Therefore, excessive tensile force is not applied to the cable 52 but the flexed cable 52 can easily absorb the impact. Accordingly, fracture of the cable 52 does not occur, and the flexed cable 52 can prevent the impact force from being transmitted to the driving portion 3. Consequently, the cable 52 should at least provide strength capable of moving the plunger 63 toward its top dead center against the biasing force of the coil spring 62. As a result, excessively large diameter cable or expensive and high strength cable is not required. Thus, a compact and light weight nail gun can be provided at low cost.

Further, almost all kinetic energy of the plunger 63 can make use of the impacting energy for driving the nail 1A, since a tension will not be applied to the cable 52 when the plunger 63 is at its bottom dead center. As a result, available impacting force can be obtained even if a smaller coil spring 62 providing a smaller resilient energy is employed, resulting in a compact and light-weight nail gun 1.

Upon moving the plunger 63 downward rapidly, the nail gun 1 other than the plunger 63 is subject to a reaction force as a counteraction. Unless the user presses the nail gun 1 toward the workpiece W strongly, the nose portion 7 may be moved away from the workpiece W, thereby moving away the nail gun 1 from the workpiece W. However, as shown in FIG. 5(*b*), since the nose urging spring 73 is interposed between the base 71 and the nose 72, that is, since the nose 72 is separated from the base 71, at least the nose 72 still stays on or close to the surface of the workpiece W, thereby guiding the nail 1A. Accordingly, the nail 1A can be adequately held and guided in the nose portion 7 during the nail driving operation without strongly pressing the nail gun 1 toward the workpiece W.

As shown in FIG. 4(*e*), the drum hook 44 rotates in the clockwise direction so that the drum 51 reaches the initial position, after the coil spring 62 has been moved to the bottom dead center and the nail 1A has been driven into the workpiece W by the plunger 63. On the other hand, the pin supporting portion 42 rotates in the counterclockwise direction, thereby moving the power transmission pin 43 from the shut-off position to the transmitting position along the pin guide groove 41*b*. Accordingly, the power transmission pin 43 latches with the hook portion 44B again and the power transmission pin 43 and the hook portion 44B return to the state shown in FIG. 4(*a*).

Further, as shown in FIG. 5(*c*), the nose 72 moves toward the base 71 by the urging force of the nose urging spring 73, thereby returning to the initial state prior to nail driving operation.

Figure 6:
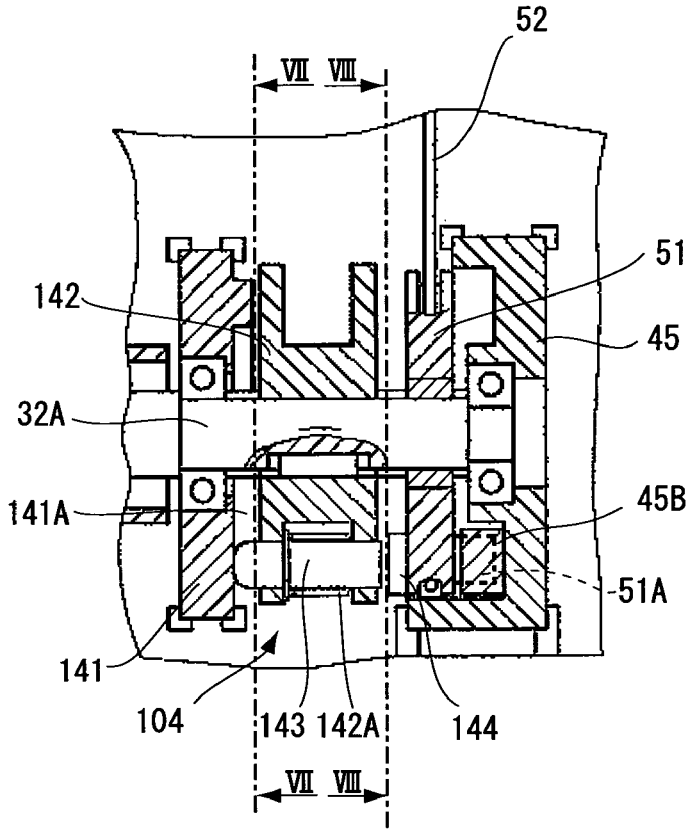
FIG. 6 is a cross-sectional view showing a clutch mechanism according to a modification to the first embodiment.

Next, a clutch mechanism according to a modification to the first embodiment of the present invention will be described with reference to FIGS. 6 through 9. As shown in FIG. 6, the clutch mechanism 104 includes a guide plate 141, a pin supporting portion 142, a power transmission pin 143, and a drum hook 144 provided on the drum 51.

Figure 7:
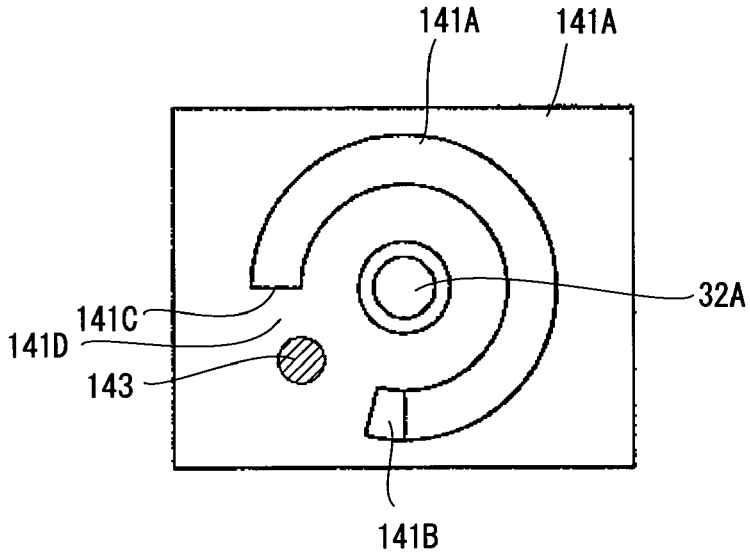
FIG. 7 is a cross-sectional view taken along a line VII-VII in FIG. 6.

As shown in FIGS. 6 and 7, the guide plate 141 is fixed to the housing 2. The guide plate 141 has a guide surface 141D which faces the pin supporting portion 142 and is adapted to contact with one end portion of the power transmission pin 143. A rail portion 141A protrudes from the guide plate 141. The rail portion 141A protrudes toward the drum 51 and extends along a locus of the power transmission pin 143, circularly moving on the guide surface 141D of the guide plate 141, in a range of 270 degrees. Further, one end portion of the rail portion 141A has a slant surface 141B and another end portion of the rail portion 141A has a plane end surface 1410 perpendicular to the guide surface 141D.

The pin supporting portion 142 having a substantially disk shape is located at a position opposite to the driving portion 3 with respect to the guide plate 141, and is coaxially rotatably fixed with the output shaft 32A by a key. Further, the pin supporting portion 142 includes a pin urging spring 142A that urges the power transmission pin 143 toward the guide plate 141.

The power transmission pin 143 is movably supported in a direction parallel to the central axis of the output shaft 32A by the pin supporting portion 142 so that the one end portion of the power transmission pin 143 faces the guide plate 141 and another end portion of the power transmission pin 143 faces the drum 51. Further, the power transmission pin 143 is urged by the pin urging spring 142A toward the guide plate 141. Thus, the one end portion of the power transmission pin 143 consistently contacts with the guide plate 141.

The drum 51 is located at a position opposite to the guide plate 141 with respect to the pin supporting portion 142. The drum hook 144 is provided on a surface of the drum 51, the surface facing the pin supporting portion 142. Further, the drum hook 144 is capable of engaging with the other end of the power transmission pin 143 while the power transmission pin 143 is positioned on the rail portion 141A.

Figure 8:
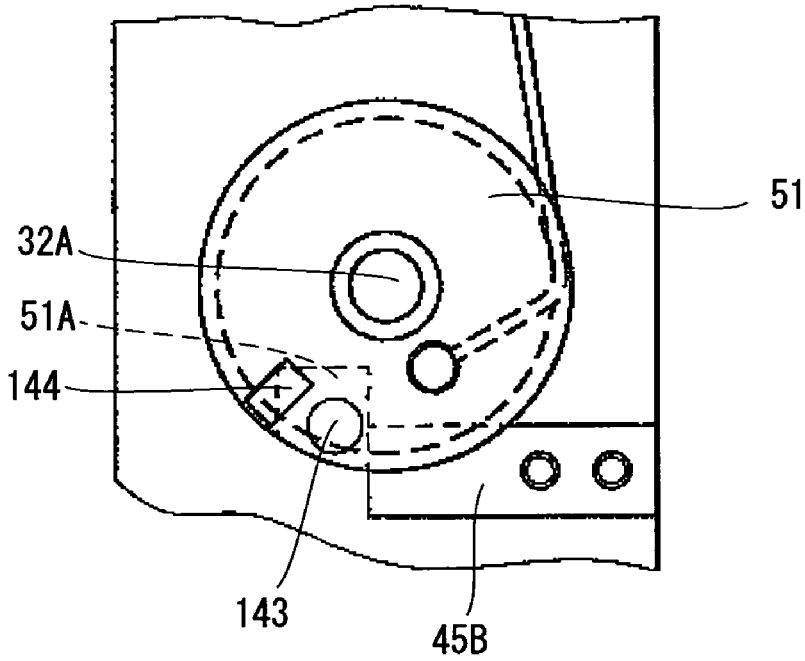
FIG. 8 is a cross-sectional view taken along a line VIII-VIII in FIG. 6.
Figure 9:
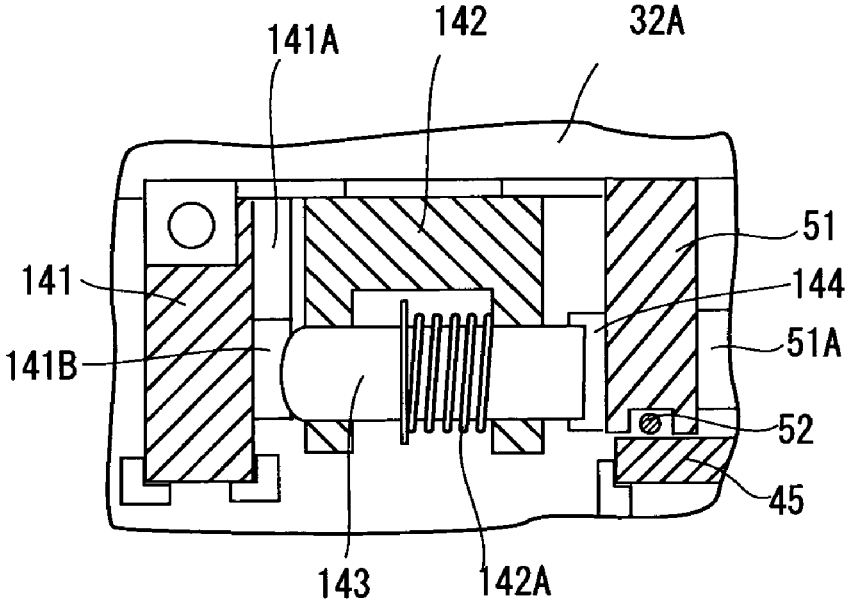
FIG. 9 is a view showing a state where the power transmission pin of the clutch mechanism is moved over a rail portion according to the modification to the first embodiment.

As shown in FIG. 8, in order to rotate the drum 51, the output shaft 32A and the pin supporting portion 142 are rotated, and the one end of the power transmission pin 143 is moved over the rail portion 141A. At this moment, the one end of the power transmission pin 143 slides the slant surface 141B and moves over the rail portion 141A. Upon moving the power transmission pin 143 over the rail portion 141A, the other end of the power transmission pin 143 projects toward the drum 51. In this state, as shown in FIGS. 8 and 9, the other end of the power transmission pin 143 latches with the drum hook 144 by rotating the pin supporting portion 142, thereby rotating the drum 51 together with the output shaft 32A and the pin supporting portion 142.

Upon rotating the output shaft 32A by 270 degrees and positioning the plunger 63 at the top dead center, the one end of the power transmission pin 143 reaches the plane end surface 141C. Since the power transmission pin 143 is urged by the pin urging spring 142A toward the guide plate 141, the one end of the power transmission pin 143 moves from the rail portion 141A to the guide surface 141D, thereby releasing the other end of the power transmission pin 143 from the drum hook 144. Thus, the drum 51 becomes freely rotatable, thereby releasing the compressed coil spring 62, and impacting and driving the nail 1A by the blade 63B of the plunger 63.

Figure 10:
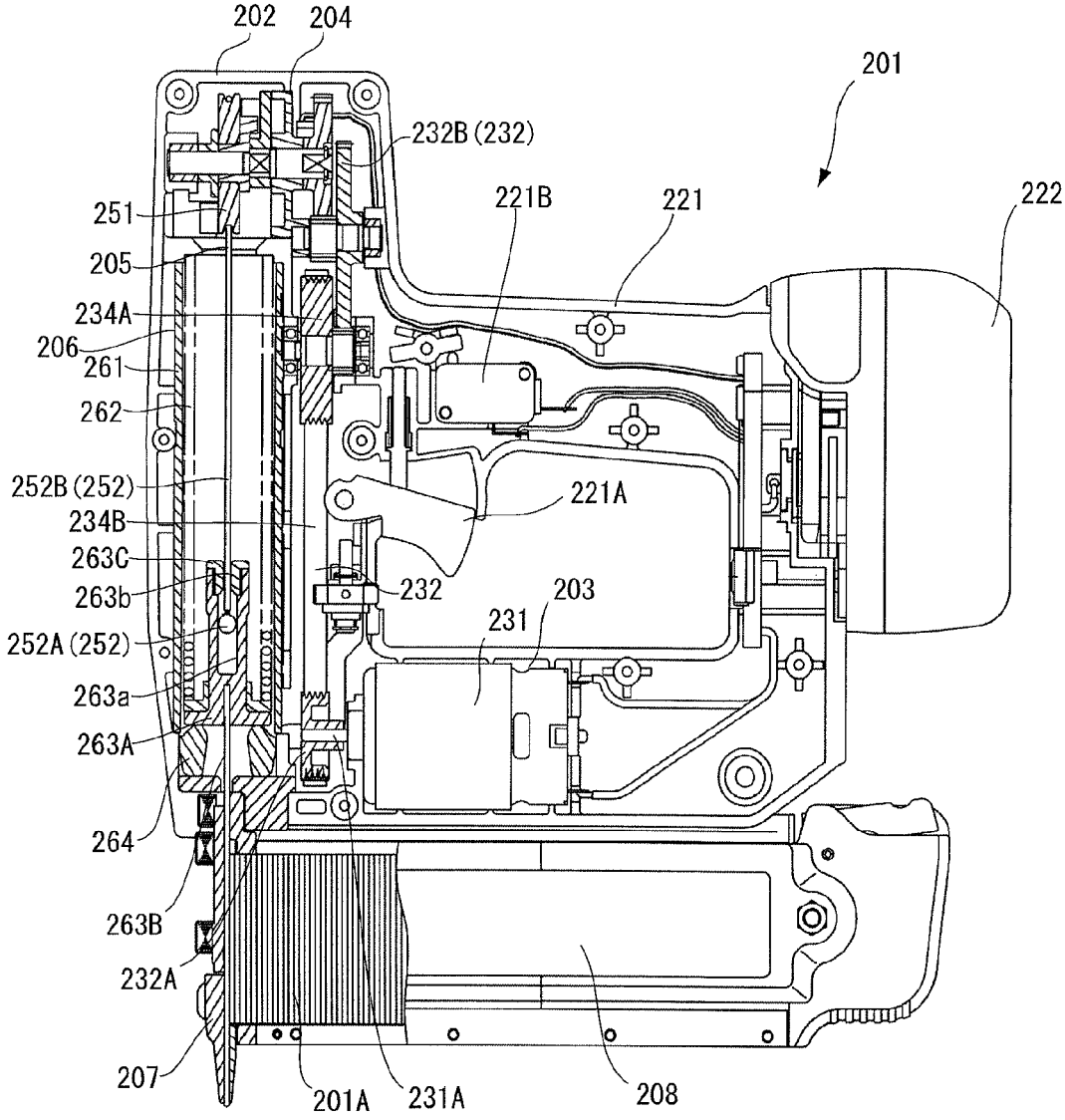
FIG. 10 is a cross-sectional view of a fastener driving tool according to a second embodiment of the present invention.

Next, a fastener driving tool according to a second embodiment of the present invention will be described with reference to FIGS. 10 through 13(*c*). As shown in FIG. 10, in the nail gun 201 according to the second embodiment, a drum 251 of a transmission portion 205 is driven to rotate by a motor 231 via a clutch mechanism 204, thereby winding a cable 252 and moving a plunger 263 to the top dead center against an urging force of a coil spring 262. Subsequently, the drum 251 is released by the clutch mechanism 204 so that the plunger 263 moves toward the bottom dead center and a nail 201A supplied from a magazine 208 to a nose 207 is impacted. Accordingly, the fastener driving tool 201 according to the second embodiment has substantially the same configuration as the fastener driving tool 1 according to the first embodiment. Therefore, description with respect to like parts and components that are the same as those of the first embodiment will be omitted, and only different aspects will be described.

A switch 221B is provided near a trigger 221A at a handle 221 in a housing 202. The switch 221B is connected to a battery 222. Upon pulling the trigger 221A, the switch 221B turns on to start electric power supply to the motor 231 from the battery 222.

A decelerating mechanism 232 is disposed between the motor 231 and the clutch mechanism 204 in a driving portion 203. The decelerating mechanism 232 includes pulleys 232A, 234A, a plurality of gears 232B, and a belt 234B. The pulley 232A is connected to a driving shaft 231A. The plurality of gears 232B is disposed between the pulley 234A and the clutch mechanism 204. The belt 234B is mounted over the pulley 232A and the pulley 234A. Rotation of the driving shaft 231A of the motor 231 is deceleratingly transmitted to the clutch mechanism 204 by the decelerating mechanism 232.

The clutch mechanism 204 has the configuration the same as that of the clutch mechanism 4, 104 of the forgoing embodiments. Thus, a connection between the drum 251 and clutch mechanism 204 is shut-off after the drum 251 rotates predetermined degrees that are degrees of rotation of the drum 251 for moving upwardly the plunger 263 from the bottom dead center to the top dead center.

The drum 251 is disposed in the housing 202 coaxially with the clutch mechanism 204 in the transmission portion 205. Further, the drum 251 is disposed in the housing 202 in such a manner that a tangent line of an outer circumference of the drum 251, the tangent line being coincident with the cable 252 wound over the outer circumference, substantially coincides with a central axis of a spring guide 261. Accordingly, the cable 252 can be wound along an axis of the spring guide 261, thereby moving the plunger 263 toward the top dead center.

The cable 252 connected to the drum 251 has a retained portion 252A and a cable portion 252B. The retained portion 252A is formed in a substantially spherical shape having a diameter larger than that of the cable portion 252B. The retained portion 252A is fixed to one end of the cable portion 252B, the one end of the cable portion 252B being opposite to another end of the cable portion 252B connected to the drum 251. A retained portion (not shown) is also provided on the other end of the cable portion 252B and is formed in a substantially spherical shape the same as that of the retained portion 252A. The retained portion (not shown) is retained by the drum 251. The cable portion 252B has fibrous steel wires bundled together as a wire bundle. A surface of the wire bundle is coated with a resin.

The cable portion 252B has a length about 10 mm or less greater than a distance between the fixing position of the cable portion 252B to the plunger 263 and the drum 251 (a distance between top dead center and the bottom dead center of the plunger 263) assuming that no deflection occurs in the cable portion 252B. Therefore, the cable portion 252B is deflected or flexed when the plunger 263 is positioned at its bottom dead center.

A coil spring portion 206 is provided which includes a spring guide 261, a coil spring 262, and the plunger 263. The spring guide 261 is provided below the drum 251. The coil spring 262 extends through the spring guide 261. The plunger 263 is urged by the coil spring 262.

Figure 11:
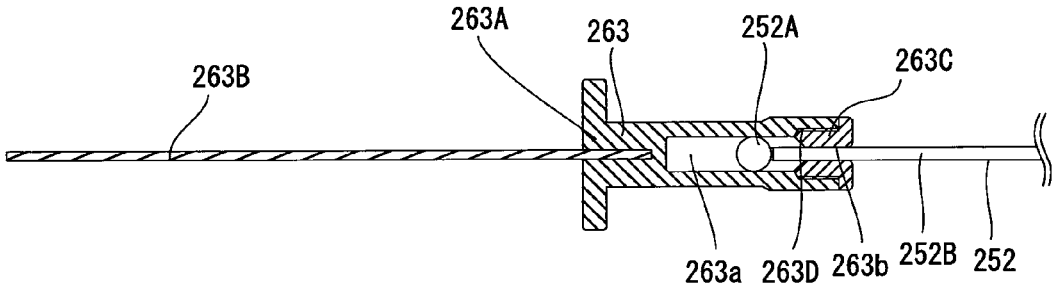
FIG. 11 is a cross-sectional view showing a plunger of the fastener driving tool according to the second embodiment.

As shown in FIG. 11, the plunger 263 includes an urging main body 263A, a blade 263B, and a retaining portion 263C. The urging main body 263A is made from resin and integrally formed with the blade 263B. The urging main body 263A has a cylindrical shape, and is formed with a space 263*a* whose one end is closed, and another end is plugged with the retaining portion 263C. The retained portion 252A is slidably disposed within the space 263*a*. The space 263*a* has a depth in the axial direction of the blade 263B, the depth allowing the retained portion 252A to slidingly move by a distance not less than twice as large as the diameter of the cable portion 252B (about 10 mm in this embodiment). The urging main body 263A has another end portion (opposite to the bottom of the space 263*a*) formed with a female thread 263D with which the retaining portion 263C is threadingly engaged. Thus, the space 263*a* is closed by the retaining portion 263C.

Figure 12:
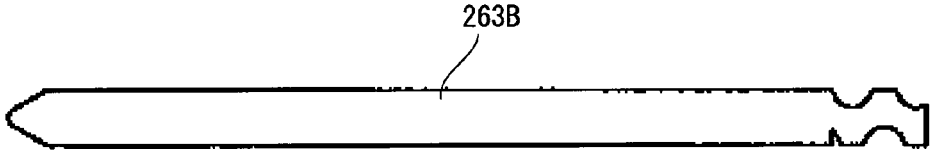
FIG. 12 is a plan view showing a blade of the fastener driving tool according to the second embodiment.

As shown in FIG. 12, the blade 263B is an elongated plate. One end of the blade 263B has a meander shape. The one end of the blade 263B is embedded into the urging main body 263A to become integral with the urging main body 263A. Thus, the one end of the blade 263B can be fixedly retained by the urging main body 263A.

As described above, the space 263*a* is closed upon threading engagement of the retaining portion 263C with the female thread 263D. The retaining portion 263C is formed with a bore 263*b* whose diameter is greater than the outer diameter of the cable portion 252B but smaller than the diameter of the retained portion 252A. Therefore, the bore 263*b* allows the cable portion 252B to pass therethrough, but prevent the retained portion 252A from passing therethrough. Thus, the plunger 263 is connected to the cable 252. Further, as shown in FIG. 10, a bumper 264 made from a resin or a soft rubber is disposed in the housing 202 at a position below the urging main body 263A. Incidentally, a groove is available instead of the bore 263D.

When the nail 201A is to be driven by the above-described nail gun 201, a user pulls the trigger 221A to turn on the switch 221B and to electrically connect the battery 222 to the motor 231, thereby supplying electric power to the motor 231. Thus, driving force of the motor 231 is transmitted to the clutch mechanism 204 to rotate the drum 251 by way of the pulleys 232A and 234A, belt 234B, and the plurality of gears 232B.

Figure 13:
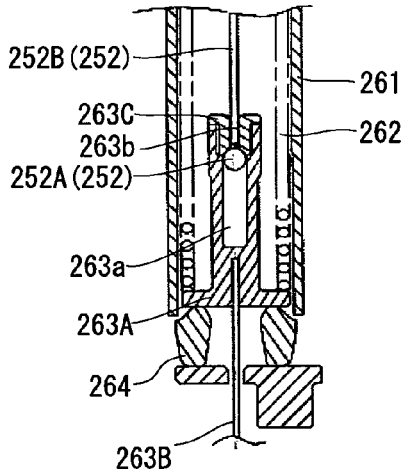
FIG. 13(*a*) is a cross-sectional view of a portion including a plunger in the fastener driving tool according to the second embodiment, in which the plunger is about to move from its bottom dead center toward top dead center.
Figure 13:
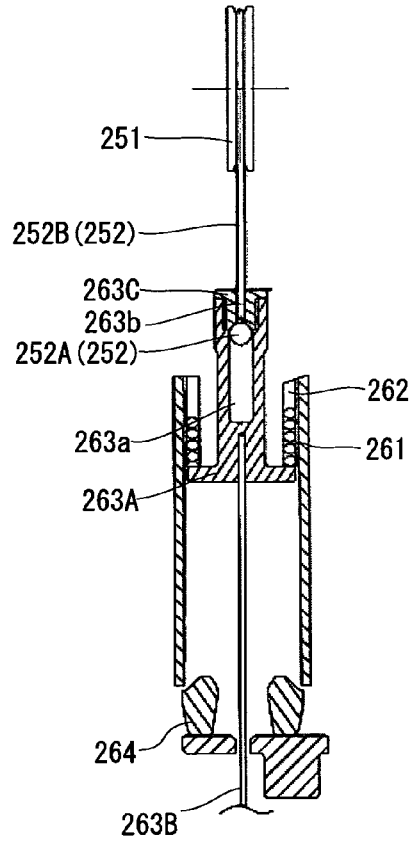
Figure 13:
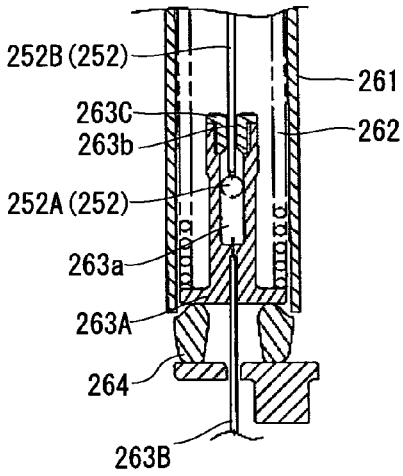

Upon winding the cable portion 252B by rotation of the drum 251, the retained portion 252A is elevated and is brought into abutment with the retaining portion 263C as shown in FIG. 13(*a*). Since the retaining portion 263C is fixed to the urging main body 263A, the retained portion 252A pulls the plunger 263 including the retaining portion 263C. Thus, as shown in FIG. 13(*b*), the retained portion 252C and the plunger 263 are integrally moved toward top dead center.

The connection between the drum 251 and the motor 231 is shut-off by the clutch mechanism 204 after the plunger 263 has moved to the top dead center. Accordingly, a force for pulling the plunger 263 toward the top dead center is shut-off, so that the plunger 263 is moved toward the bottom dead center for driving the nail 201A by the biasing force of the coil spring 262. Then, as shown in FIG. 13(*c*), the plunger 263 strikes against the bumper 264.

Movement of the plunger 263 is stopped upon abutment with the bumper 264. However, since the cable 252 has a surplus length, the retained portion 252A can be slidingly moved within the space 263*a* to move away from the retaining portion 263C. As a result, mechanical association between the cable 252 and the plunger 263 is shut off. Consequently, transmission of any impact force occurring at the plunger 263 to the cable 252 can be avoided, and no excessive tensile force is applied to the cable 252 at this timing. Further, inertia force will be applied to the cable 252 due to rapid movement of the cable 252 from the top dead center to the bottom dead center. Therefore, stress concentration may occur at the bottom dead center side of the cable 252 due to a sudden stop of the plunger 263 at the bottom dead center. That is, unwanted bending or buckling may occur at the connecting portion of the cable 252 to the plunger 263. However, since break-off relationship is provided between the cable 252 and the plunger 263 at the bottom dead center, such bending or buckling can be restrained, and consequently, any breakdown of the cable portion 252B can be eliminated.

Further, the cable 252 may be distorted or twisted during assembly of the nail gun 201 or during winding of the cable 252 over the drum 251. However, since break-off relationship is provided between the cable 252 and the plunger 263 at the bottom dead center, the cable 252 can be rotated about its axis with respect to the plunger 263 to rectify the distortion.

Figure 14:
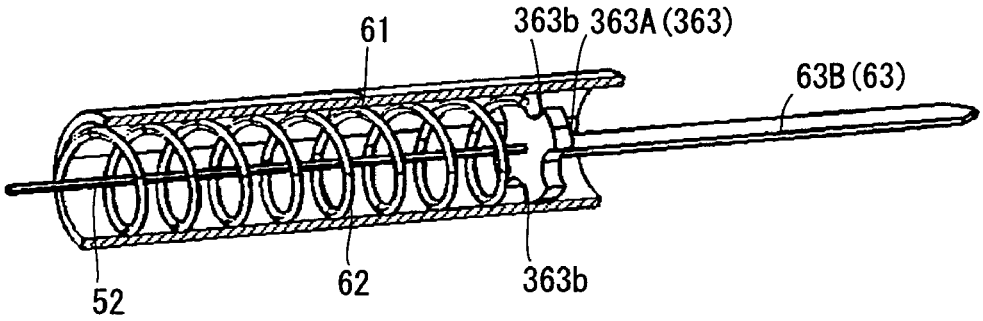
FIG. 14 is a perspective view showing a periphery of a spring guide according to a first modification to the embodiments.

While the invention has been described in detail with reference to specific embodiment thereof, it would be apparent to those skilled in the art that various changes and modifications may be made therein without departing from the scope of the invention. For example, as shown in FIG. 14, an urging portion 363A of a plunger 363 according to a modification may be formed with a plurality of grooves 363*b*. The plurality of grooves 363*b* is open on the first space and the second space of the spring guide 61. With this structure, the first space and the second space can be in fluid communication with each other via the plurality of grooves 363*b*. Therefore, the air damper effect can be prevented.

Figure 15:
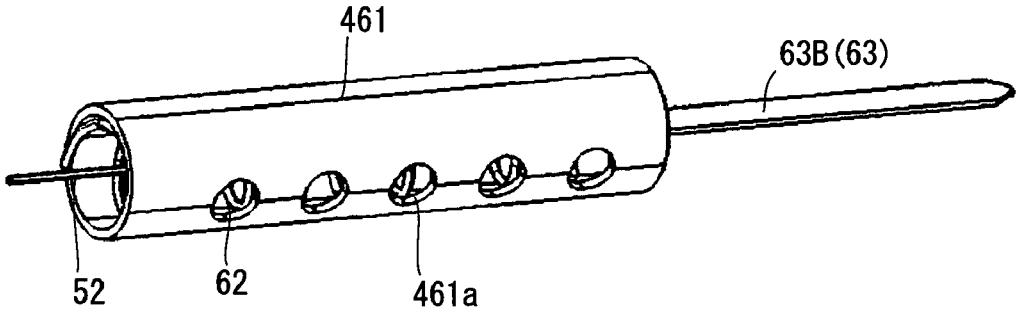
FIG. 15 is a perspective view showing a periphery of a spring guide according to a second modification to the embodiments.

Further, as shown in FIG. 15, a spring guide 461 according to another modification may be formed with a plurality of though-holes 461*a*. A space in the spring guide 461 is in fluid communication with outside air via the plurality of through-holes 461*a*.

Figure 16:
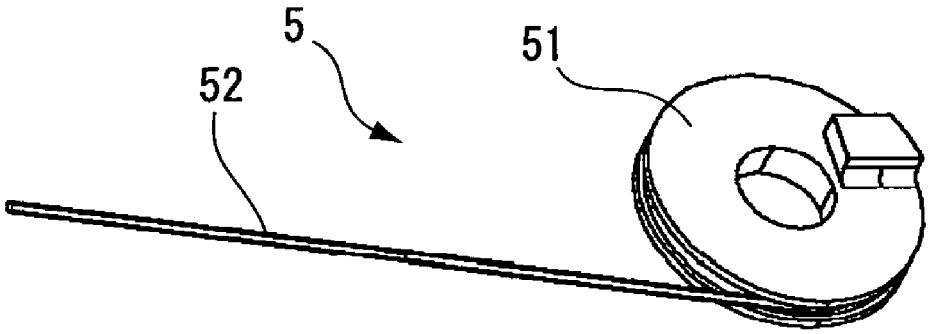
FIG. 16 is an exploded perspective view showing a clutch mechanism of a fastener driving tool according to a modification to the first embodiment.
Figure 16:
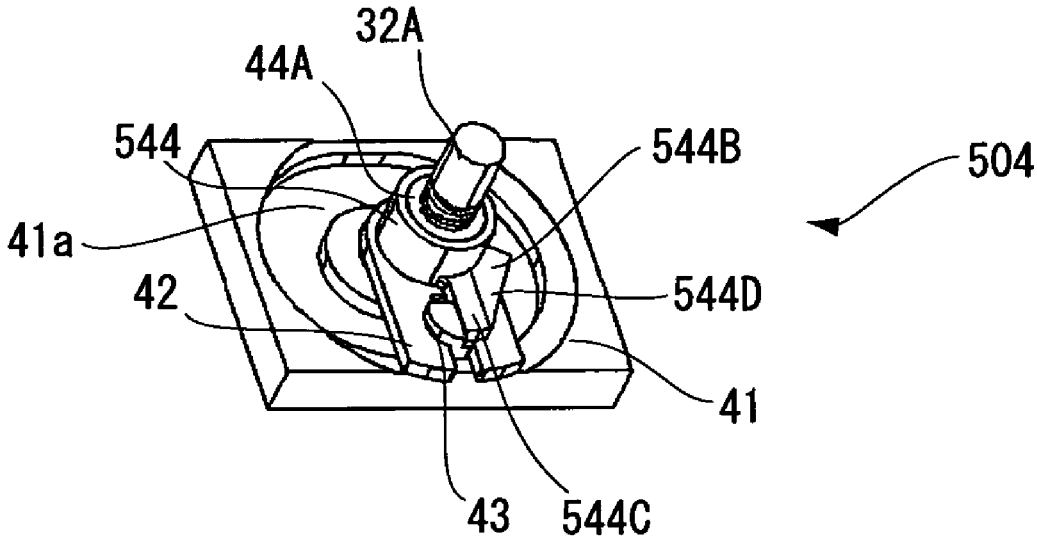

Further, as shown in FIG. 16, a clutch mechanism 504 according to a modification to the first embodiment may include a drum hook 544 having a hook portion 544B. The hook portion 544B may include a first portion 544C made from a metal and a second portion 544D made from a resin having a density lower than that of the metal. The first portion 544C slidably contacts the power transmission pin 43 when the output shaft 32A rotates. Since the first portion 544C is made from the metal, the first portion 544C has an abrasion resistance against the power transmission pin 43. Further, since the second portion 544D is made from the resin, the drum hook 544 can have a lightweight structure. Accordingly, the nail gun and a portion which rotates with the drum 51 to be pulled by the cable 52 in the nail driving operation can have a lightweight structure, thereby improving a response of the drum hook 544 in the nail driving operation. That is, the drum hook 544 can easily return to the initial position after the nail driving operation.

Figure 17:
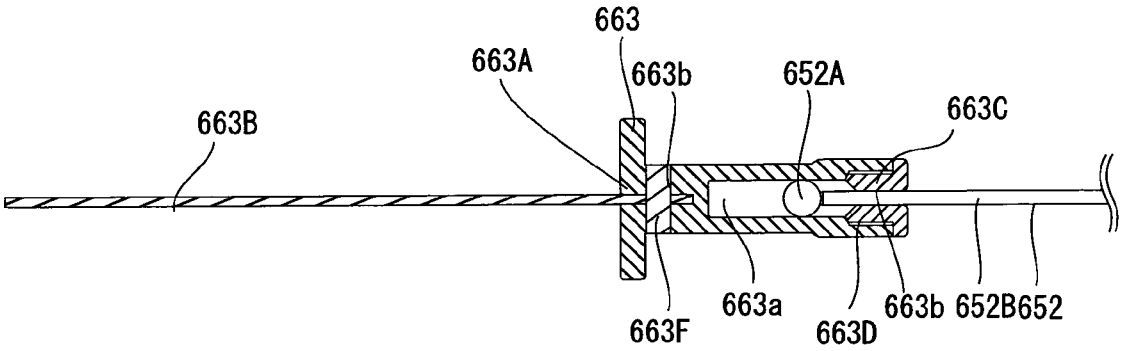
FIG. 17 is a cross-sectional view showing a plunger of the fastener driving tool according to a modification to the second embodiment.
Figure 18:
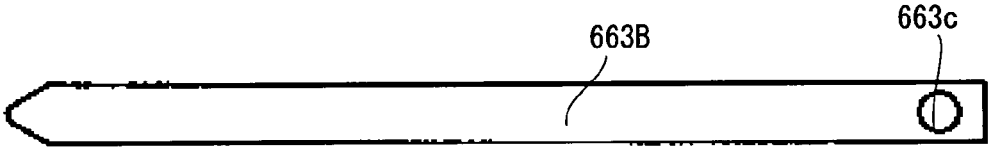
FIG. 18 is a plan view showing a blade of the fastener driving tool according to a modification to the second embodiment.

Further, as shown in FIG. 17, a plunger 663 according to a modification to the second embodiment includes an urging main body 663A, a blade 663B and a pin 663F. The urging main body 663A and the blade 663B are connected by the pin 663F. The urging main body 663A is formed with a through-hole 663*b* through which the pin 663F is inserted. As shown in FIG. 18, the blade 663B is formed with a through-hole 663*c* through which the pin 663F is inserted. Accordingly, the pin 663F is inserted into the through-holes 663*b* and 663*c* in a state that the blade 663B is attached to the urging main body 663A, thereby fixing the blade 663B with the urging main body 663A.

The invention claimed is:

1. A fastener driving tool comprising:

a housing;

a motor provided in the housing;

a plunger provided in the housing and movable between its top dead center and its bottom dead center for impacting a fastener in a fastener driving direction;

a cable member connected to the plunger for pulling the plunger from the bottom dead center to the top dead center;

a drum driven by the motor for winding the cable member, the cable member being connected to the plunger at a first connecting position and connected to the drum at a second connecting position; and a biasing spring associated with the plunger for biasing the plunger in the fastener driving direction, the biasing spring being configured to accumulate a driving force of the motor as a resilient energy;

wherein the cable member has a length greater than a distance between the first connecting position and the second connecting position when the plunger is at the bottom dead center.

2. The fastener driving tool as claimed in claim 1, wherein the cable member is connected to the drum and is deflectable between the drum and the plunger when the plunger is at the bottom dead center.

3. The fastener driving tool as claimed in claim 1, further comprising a nose supported to the housing and movable in the fastener driving direction with respect to the housing for guiding movement of a fastener driven by the plunger, the nose having a tip end in the fastener driving direction, and the plunger having a striking end protrudable from the tip end.

4. The fastener driving tool as claimed in claim 3, further comprising a nose urging spring interposed between the nose and the housing for biasing the nose in a direction opposite to the fastener driving direction.

5. A fastener driving tool comprising:

a housing;

a motor provided in the housing;

a plunger provided in the housing and movable between its top dead center and its bottom dead center for impacting a fastener in a fastener driving direction;

a cable member connected to the plunger for pulling the plunger from the bottom dead center to the top dead center;

a drum driven by the motor for winding the cable member by a length greater than a distance between the top dead center the bottom dead center; and a biasing spring associated with the plunger for biasing the plunger in the fastener driving direction, the biasing spring being configured to accumulate a driving force of the motor as a resilient energy;

wherein the cable member is connected to the plunger at a first connecting position and to the drum at a second connecting position; and wherein the cable member has a length from 1 mm to 10 mm greater than a linear distance between the first connecting position and the second connecting position when the plunger is at the bottom dead center.

6. A fastener driving tool comprising:

a housing;

a motor provided in the housing;

a plunger provided in the housing and movable between its top dead center and its bottom dead center for impacting a fastener in a fastener driving direction;

a cable member connected to the plunger for pulling the plunger from the bottom dead center to the top dead center;

a drum driven by the motor for winding the cable member by a length greater than a distance between the top dead center and the bottom dead center; and a biasing spring associated with the plunger for biasing the plunger in the fastener driving direction, the biasing spring being configured to accumulate a driving force of the motor as a resilient energy;

wherein the cable member comprises a cable portion having one end and another end connected to the drum; and a retained portion provided at the one end of the cable portion and retained by the plunger; and wherein the plunger has a retaining portion formed with a closed space defined by an end portion and formed with one of a bore and a groove extending through the end portion in the fastener driving direction, the retained portion being movable in the closed space in the fastener driving direction, and the cable portion extending through the one of the bore and the groove which prevents the retained portion from passing therethrough, the retained portion being spaced away from the end portion when the plunger is at the bottom dead center.

7. The fastener driving tool as claimed in claim 6, wherein the retained portion is spaced away from the end portion by a distance not less than twice as large as a diameter of the cable portion.

8. The fastener driving tool as claimed in claim 6, wherein the cable portion is rotatable about its axis with respect to the retaining portion.

* * * * *